US007861866B1

(12) United States Patent
Ondrias

(10) Patent No.: US 7,861,866 B1
(45) Date of Patent: Jan. 4, 2011

(54) SCREENING SYSTEM WITH KNOCKING DEVICE

(75) Inventor: Louis A. Ondrias, Lexington, KY (US)

(73) Assignee: Tema Isenmann, Inc., Lexington, KY (US)

( * ) Notice: Subject to any disclaimer, the term of this patent is extended or adjusted under 35 U.S.C. 154(b) by 2 days.

(21) Appl. No.: 12/396,841

(22) Filed: Mar. 3, 2009

Related U.S. Application Data

(60) Provisional application No. 61/034,532, filed on Mar. 7, 2008.

(51) Int. Cl.
*B07B 1/54* (2006.01)

(52) U.S. Cl. ..... 209/382; 209/381

(58) Field of Classification Search ..... 209/379, 209/381, 382
See application file for complete search history.

(56) References Cited

U.S. PATENT DOCUMENTS

| | | | | | |
|---|---|---|---|---|---|
| 254,009 | A | * | 2/1882 | Harvey | 209/382 |
| 615,524 | A | | 12/1898 | Brandstaedter | |
| 669,586 | A | | 3/1901 | Levasseur | |
| 2,858,023 | A | * | 10/1958 | Holland | 209/381 |
| 3,087,617 | A | | 4/1963 | Forsberg | |
| 4,122,006 | A | | 10/1978 | Christensen et al. | |
| 4,861,462 | A | * | 8/1989 | Lehmann et al. | 209/269 |
| 5,051,171 | A | * | 9/1991 | Hukki | 209/323 |
| 5,165,550 | A | | 11/1992 | Pierson et al. | |
| 5,456,364 | A | * | 10/1995 | Lambert | 209/382 |
| 6,364,118 | B1 | * | 4/2002 | Anderle et al. | 209/382 |
| 6,422,394 | B1 | | 7/2002 | Page | |
| 7,114,620 | B2 | * | 10/2006 | Anibas | 209/319 |
| 7,416,085 | B2 | | 8/2008 | Kadel | |
| 7,621,406 | B2 | * | 11/2009 | Freissle et al. | 209/405 |

FOREIGN PATENT DOCUMENTS

| | | |
|---|---|---|
| DE | 296513 | 2/1917 |
| DE | 8435585.9 | 1/1985 |
| WO | 02074454 | 9/2002 |

* cited by examiner

*Primary Examiner*—Joseph C Rodriguez
(74) *Attorney, Agent, or Firm*—Wood, Herron & Evans, LLP

(57) ABSTRACT

A screening system with knocking devices includes a screen panel support, connector bars, knocking devices, and screen panels. The knocking devices are generally spherical-shaped balls held by elastic arms connected to the connector bars. When the screening system is activated by moving material onto the screen panels and vibrating the screen panel support, the knocking devices bounce around the undersurface of the screen panels and prevent the build-up or jamming of material blocking the openings in the screen panels. The knocking device and screen panels are separate so that when one of those elements becomes defective, the screening system can be fixed without replacing both elements.

18 Claims, 3 Drawing Sheets

SCREENING SYSTEM WITH KNOCKING DEVICE

This claims priority to U.S. Provisional Patent Application Ser. No. 61/034,532, filed Mar. 7, 2008 and hereby incorporated by reference in its entirety.

BACKGROUND OF THE INVENTION

This invention relates to the general field of screening systems and particularly to screening systems with a screen or sieve having openings and devices used to free the screen from material blocking or plugging the openings.

In mining and related fields, screening systems are used to separate fine pieces of material from larger pieces of material. These screening systems generally include some number of screen panels which sit on a framework of steel girders. When the steel girders are jostled and moved around, fine material on the screen panels drops through the openings in the screen and larger pieces of material bounce off the screens and off the sides of the screening system, where those larger pieces are collected for further processing.

In some screening applications fine material will begin sticking to the screen surface and build up to the point where fine material bridges over the openings in the screen. This bridging of fine material reduces the size of the openings in the screen (commonly referred to as blinding), which can get progressively worse over time. Once a sufficient percentage of the screen openings is blinded by bridged fine material, the screening system is too ineffective and must be shut down so that the screens can be removed or manually cleaned. This can frequently shut down an entire mining operation or plant, especially if the material being screened is damp or irregularly-shaped.

In addition to the problems with fine material bridging the openings, larger angular or irregular-shaped particles in the material can become lodged in the openings of the screen, blocking it much like blinding. This problem is widely referred to as plugging or pegging. The effects of plugging are very similar to those of blinding.

The mechanical action of a screening system causes some level of G-forces to be exerted on the screen panels. This mechanical action drives the screening process and helps avoid blinding or plugging of the screens, but the speed and stroke of the mechanical action must be within industry standards. If the screening system is running at maximum G-force (maximum referring to the state where an increase in speed will damage the screening system) and plugging or blinding still occurs, there needs to be some other mechanical means to vibrate or impact the screen and keep the screen surface clean.

Some of the screening system manufacturers have tried to solve this plugging and blinding problem with a design that incorporates steel wire baskets attached to the steel girders below every screen panel. These steel wire baskets contain rubber or urethane balls placed within the basket so that when the mechanical action of the screening system is activated, the balls bounce repeatedly off the steel wire baskets and into the bottom of the screen panels to help prevent blinding and plugging. These steel wire baskets wear out easily with abrasive materials being screened, and the frequent replacement of these baskets is time-consuming and expensive. These steel baskets also cannot be retrofitted to older screening systems, but can only be attached to newer screening systems designed to incorporate the baskets.

One design which attempted to solve the problems of the steel basket systems by attaching a beating device such as a plastic ball attached to rubberized arms connected to the frame of a screen panel is disclosed in U.S. Pat. No. 7,416,085. That system addressed many of the problems with the steel basket design, but attaching the beating device directly to the screen panel leads to different problems. New screen panels needed to be created to allow integration with the beating devices, and if one of the two elements is defective or broken, the entire screen panel and beating device unit must be replaced.

Consequently, it would be desirable to come up with a screening system which overcomes these and other problems with prior art systems and can knock loose build-ups of blinding and plugging material while being resilient to the abrasive materials typically screened with these machines.

SUMMARY OF THE INVENTION

This invention solves these and other problems with known screening systems. The invention in one embodiment is a screening system including a machine frame, girders, connectors, a screen panel, an elongated element, and a beater. The machine frame includes at least two girders, and the connectors are coupled to those girders. The screen panel includes at least one generally horizontal screen and a frame holding the screens. The frame of the screen panel is connected to adjacent connectors on opposite sides of the frame. The elongated element includes opposite ends attached to the adjacent connectors, and the elongated element holds the beater between these opposite ends. The beater consequently is located just below the screen panel, and during screening operations it knocks against the screens to free built-up particles of material lodged in openings of the screens.

In some embodiments, the connectors are connector bars and include a cross section including a top knob, a bottom knob, and a central rectangular section which creates opposing side surfaces of the connector bar. The top knob is designed to hold the screen panel in place, and the screen panel frame has concave opposing side edges to engage the top knob. The opposing side surfaces of the connector bar have notches at various intervals, and the ends of the elongated element are designed to fit in these notches. The ends and notches can be any shape which allows the elongated element to be removably attached to adjacent connector bars, but one embodiment includes dovetail-shaped ends and notches. The screen panel and beater can each be made of resilient plastic material to help these parts last longer before failure.

The invention also includes a method of constructing the screening system described above. The method includes hammering the bottom knob of the connector bar into girders which make up the machine frame. The elongated element is then attached to the notches in adjacent connector bars. The final step is to hammer the screen panel onto the top knob portion of the adjacent connector bars. Once completed, the beater and elongated element engage the screen panel.

The invention further includes a method of screening material to remove fine particles of material from larger or course particles of material using a screening system as described above and including a machine frame, connector bars, a screen panel, an elongated element, and a beater. The method includes delivering material made of fine and course pieces onto the screen panel, followed by actuating the machine frame with vibratory or shaking movement to shake the connector bars and screen panel. This vibratory or shaking motion of the connector bars actuates the elongated element, causing the beater to bounce against the underside of the screen panel to remove built-up material on the screen panel.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
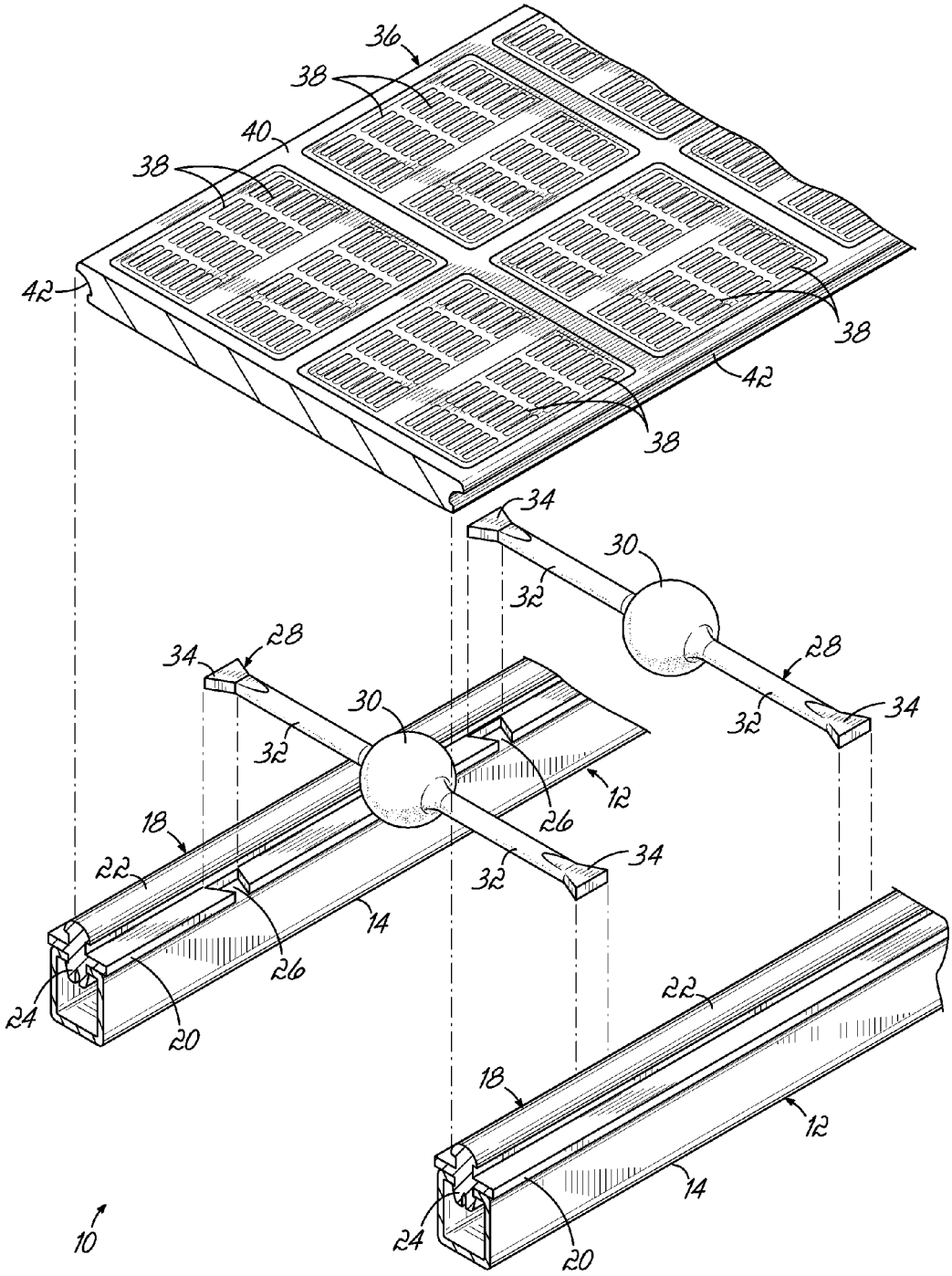
FIG. 1 is an exploded perspective view of one embodiment of a screening system according to this invention.
Figure 2:
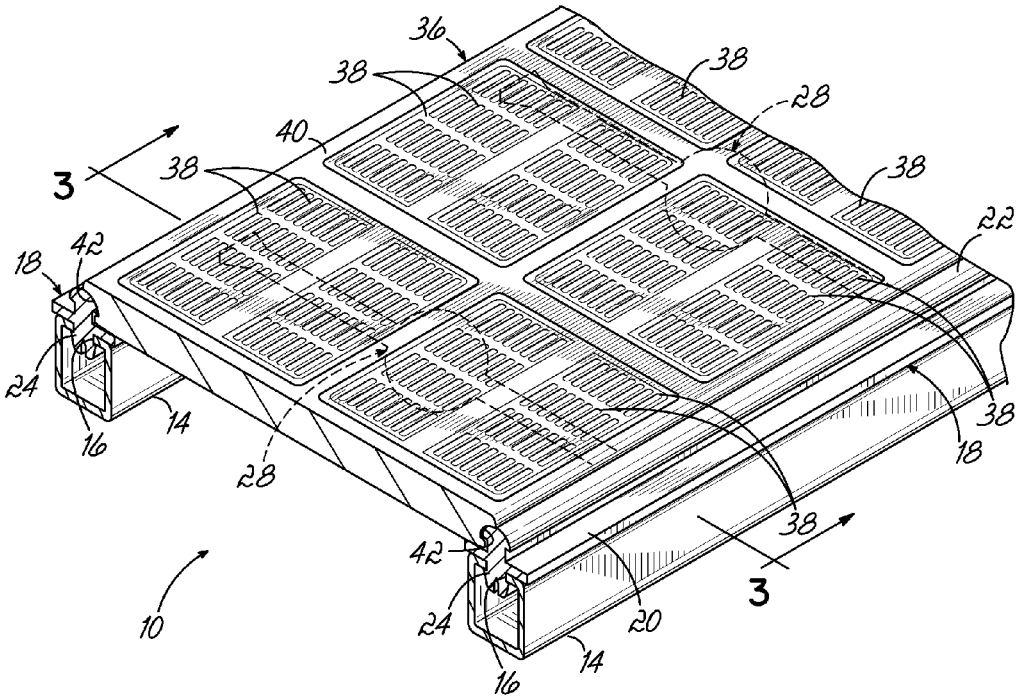
FIG. 2 is a perspective view of the screening system of FIG. 1 in operating position.
Figure 3:
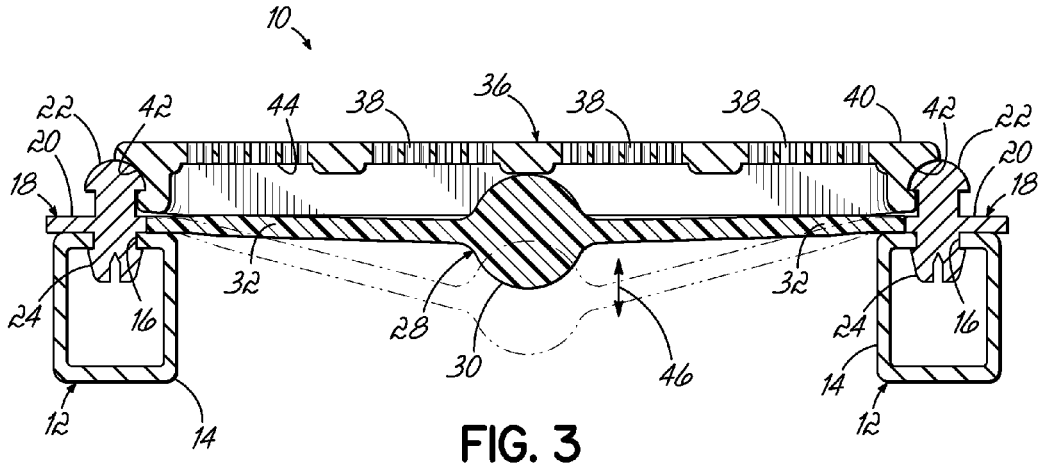
FIG. 3 is a cross-sectional view taken along line 3-3 of the screening system of FIG. 2 illustrating the movement of a knocking device.

One exemplary embodiment demonstrating various features and aspects of a screening system 10 according to this invention is shown in FIGS. 1-3. The screening system 10 of this invention includes a support member in the form of a girder or the like 12 coupled to a vibrating machine, connectors 18, knocking devices 28, and screen panels 36, only one of which is shown. While one exemplary screening system 10 is shown and described herein, it will be readily appreciated that this invention is not limited to any particular screening system.

As shown in FIG. 1, the screen panel support 12 is made from a framework of girders 14. Each girder 14 has a generally tubular cross-sectional configuration with an opening 16 on a top surface of the girder 14. A connector 18, which in one embodiment is a bar and is referred to as a "nokin bar," is hammered into the opening 16 of each girder 14 of the machine frame 12. The connector 18 may be a rigid bar with a cross-section most easily shown in FIG. 3. The cross-section of the connector bar 18 includes a central rectangular section 20, a top knob 22 which is typically rounded and integral with the central rectangular section 20, and a bottom knob 24 adapted to fit within the opening 16 to hold the connector bar 18 in place with respect to the girder 14. At regular intervals down the length of the connector bar 18, openings or grooves 26 are formed in the central rectangular section 20 of the connector bar 18. The connector 18 according to this invention may be of another configuration or design.

Figure 4:
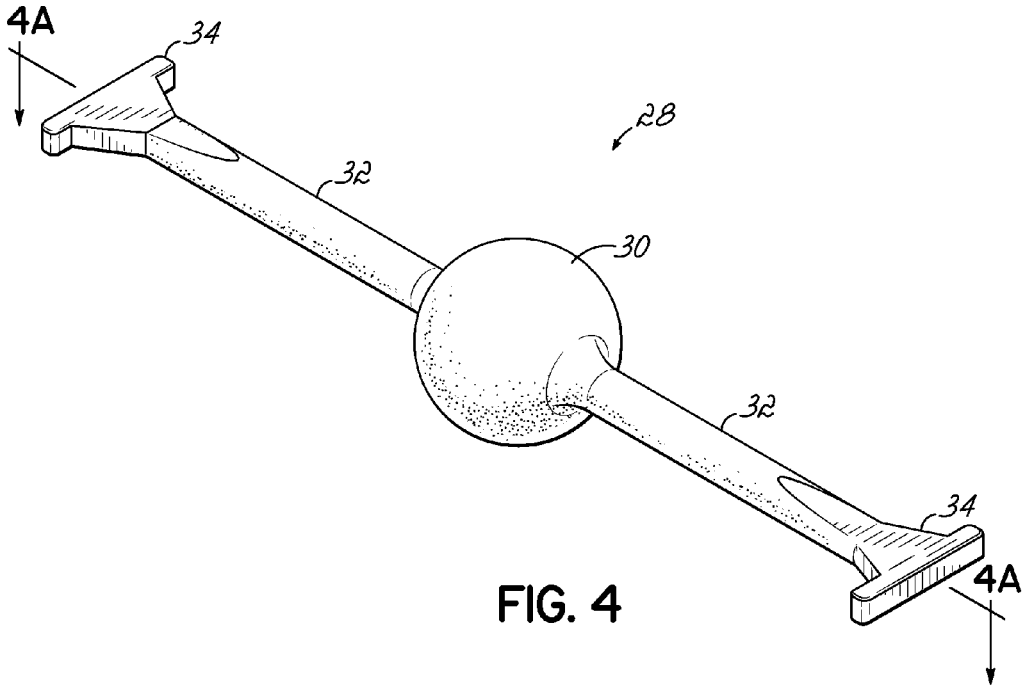
FIG. 4 is a perspective view of an alternative embodiment of a knocking device according to this invention.
Figure 4A:
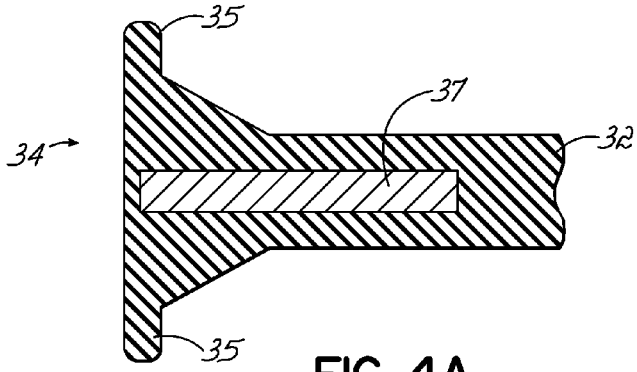
FIG. 4A is a cross-sectional view taken along line 4A-4A of FIG. 4.
Figure 4B:
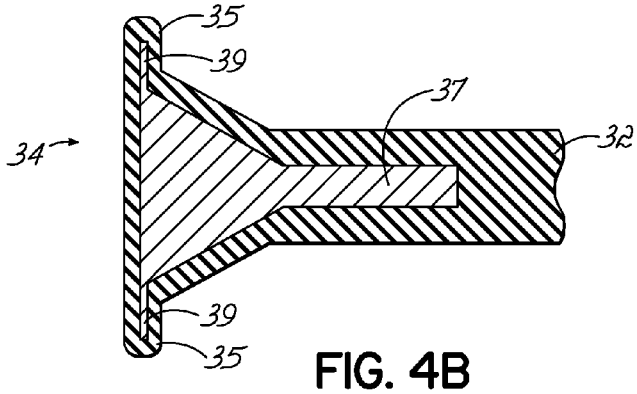
FIG. 4B is a view similar to FIG. 4A of a further alternative embodiment of a knocking device according to this invention.

The knocking device 28 is designed to couple to the connectors 18 using these grooves 26. The knocking device 28 includes a beater 30, which is surrounded by and connected to a pair of elastic arms 32. The distal end 34 of each arm 32 is configured to fit in the grooves 26 of the connector 18. The ends 34 and grooves 26 are shown in the drawings as dovetail-shaped, but it will be appreciated that alternative shapes of the ends 34 and grooves 26 are possible as well as other techniques for coupling the knocking device 28 to the connectors 18. For example, an alternative embodiment of the knocking device according to this invention is shown in FIGS. 4-4B. The knocking devices 28 shown in FIGS. 4-4B include opposing and laterally projecting tabs 35 on each of the ends 34. Moreover, inserts 37 are embedded in each end 34 to increase the strength of the device 28 and minimize the likelihood that the end 34 would break or rupture from the arm 32. The insert 37 may also have tabs 39 (FIG. 4B) and be metal or of another material and configured in the shape shown in FIG. 4A, FIG. 4B or another shape according to this invention. The beater 30 is any kind of plastic or resilient material that can impact the screen panels 36 to jar loose materials stuck on the screen panel, and may be a plastic ball or sphere as shown in FIGS. 1-4. The arms 32 are any kind of elastic and resilient material, as they act like a rubber band between the connectors 18 and the beater 30. In one embodiment, the ends 34, arms 32 and beater are integrally molded urethane, polyurethane or another material of 60, 75, 82 or 90 durometer or another design.

The screen panel 36 includes a plurality of screens 38 with openings to sieve through fine and course material, and a panel frame 40 surrounding and holding the screens 38. The screens 38 and panel frame 40 are usually made out of polyurethane plastic, but other materials can be used. The screens 38 and panel frame 40 may be connected by gluing, welding, or casting, or the screens 38 and panel frame 40 could be formed integral with one another. The panel frame 40 projects downwardly from the screens 38 at each side 42 of the panel frame 40. As shown most clearly in FIG. 1, the opposing side walls 42 are shaped as a rounded cavity. These opposing side walls 42 are thus adapted to mate with the rounded top knob 22 of the connector 18. As shown in FIG. 3, within these opposing side walls 42 is the undersurface 44 of the screen panel 36 which is contacted by the beater 30 during operation of the screening system 10.

The construction of the embodiment of a screening system 10 shown in FIGS. 1-3 is as follows. Once the screen panel support 12 is assembled, the bottom knob 24 of each connector 18 is knocked or hammered into the opening 16 in the associated girder 14. The knocking devices 28 can then be added to the system 10 by fitting the ends 34 into the grooves 26 as illustrated by the phantom lines in FIG. 1. Then a screen panel 36 with side walls 42 in the shape of a round cavity can be knocked or hammered into place between the top knobs 22 of adjacent spaced connectors 18. The reason the connector 18 is commonly referred to as a "nokin bar" as referenced above is because the screen panels 36 are knocked into place between the connector bars 18. Once all of these steps have been completed, the assembly of the screening system 10 is complete as shown in FIG. 2.

After construction, the screening system 10 of FIGS. 1-3 operates as follows. First, a mechanical agitator or other control system imparts vibration or shaking motion to the screen panel support 12. As the girders 14 move, the connector bars 18 and screen panels 36 also vibrate, and the screen panel 36 shakes fine material atop the screen through the openings of the screen 38 while retaining larger and more course pieces of material atop the screen 38. The shaking of the connector bars 18 leads the beater 30 to elastically bounce into contact with the undersurface 44 of the screen panel 36 as shown by arrow 46 and the phantom representation of FIG. 3. The beaters can move transversely, longitudinally, and/or diagonally relative to the screen 38. The repeated impact by the beater 30 breaks up blinding material and dislodges plugging materials from reducing the opening size in the screen 38. Consequently, the screening system 10 can operate for longer periods of time than the prior art before a screen panel 36 has to be removed for cleaning the plugging and blinding materials from the openings, even in damp environments.

The embodiments shown in FIGS. 1-4B of a screening system 10 has another benefit over prior art systems. Connecting the knocking devices 28 to the connector bars 18 instead of directly to the screen panels 36 or screen panel frames 40 leads to easier installation and replacement. In case the elastic arms 32 or beater 30 becomes defective over the course of screening, the original screen panel 36 does not need to be replaced but instead can be knocked back on the connector bars 18 once a replacement knocking device 28 is placed in the system 10. While this invention has been illustrated by a description of various embodiments and while these embodiments have been described in considerable detail, each inventor does not intend to restrict or in any way limit the scope of the appended claims to such detail. Additional advantages and modifications will readily appear to those skilled in the art. The invention in its broader aspects is therefore not limited to the specific details, representative methods and apparatus, and illustrative examples shown and described. Accordingly, departures may be made from such details without departing from the spirit of the inventor's general inventive concept. The scope of the invention itself should only be defined by the appended claims.

I claim:

1. A screening system comprising:

a support including at least two spaced girders;

at least two connectors each coupled to one of the girders;

a screen panel having at least one generally horizontal screen and a frame holding the screen and coupled to the connectors at two opposing edges of the frame;

an elongated element having opposite ends attached to adjacent connectors and extending generally horizontally underneath the screen panel, and a beater on the elongated element between the opposite ends and underneath the screen panel, the beater repeatedly engaging the screens to free built-up particles of material lodged in openings of the screens.

2. The screening system of claim 1, wherein the connectors each further comprise a bar and a longitudinal top knob adapted to engage and hold the screen panel in place.

3. The screening system of claim 2, wherein the two opposing edges of the screen panel frame each have concave surfaces sized to engage the top knob on the connector bars.

4. The screening system of claim 1, wherein the connectors further comprise opposing side surfaces with notches therein, and the ends of the elongated element are sized to removably mate with the notches to suspend the beater beneath the screen panel.

5. The screening system of claim 4, wherein the notches and ends of the elongated element have a dovetail shape.

6. The screening system of claim 1, wherein the beater and screen panel are each formed from resilient plastic material.

7. The screening system of claim 1 wherein the elongated elements and the beater are each integrally molded.

8. The screening system of claim 1 wherein the screen panel is independently removable from the machine frame while the elongate element and the beater remain attached to the support.

9. A screening system comprising:

a support including at least two spaced girders;

at least two connectors each coupled to one of the girders;

a screen panel having at least one generally horizontal screen and a frame holding the screen and coupled to the connectors at two opposing edges of the frame;

an elongated element having opposite ends attached to adjacent connectors and extending generally horizontally underneath the screen panel;

a beater on the elongated element between the opposite ends and underneath the screen panel, the beater repeatedly engaging the screens to free built-up particles of material lodged in openings of the screens; and an insert embedded within each elongate element.

10. The screening system of claim 9 further comprising a pair of the inserts, each embedded in the elongate element proximate one of the ends thereof that is attached to the associated connector.

11. A screening system comprising:

a support including at least two spaced girders;

at least two connectors each coupled to one of the girders;

a screen panel having at least one generally horizontal screen and a frame holding the screen and coupled to the connectors at two opposing edges of the frame;

an elongated element having opposite ends attached to adjacent connectors and extending generally horizontally underneath the screen panel;

a beater on the elongated element between the opposite ends and underneath the screen panel, the beater repeatedly engaging the screens to free built-up particles of material lodged in openings of the screens; and a longitudinal opening in a top surface of each girder sized and adapted to releasably retain a downwardly projecting portion of the associated connector therein.

12. A screening system comprising:

a screen panel support including at least two spaced girders;

at least two connector bars each coupled to one of the girders;

a screen panel having at least one generally horizontal screen and a frame holding the screen and coupled to the connector bars at two opposing edges of the frame;

a longitudinal opening in a top surface of each girder sized and adapted to releasably retain a downwardly projecting portion of the associated connector bar therein;

an elongated element having opposite ends attached to adjacent connector bars and extending generally horizontally underneath the screen panel;

a beater on the elongated element between the opposite ends and underneath the screen panel, the beater repeatedly engaging the screens to free built-up particles of material lodged in openings of the screens;

a longitudinal top knob projecting from each connector bar and adapted to engage and hold the screen panel in place;

wherein the two opposing edges of the screen panel frame are concave surfaces sized to engage the longitudinal top knob on the connector bars;

at least two notches formed in side surfaces of the connector bars adapted to removably mate with the ends of the elongate element to suspend the beater beneath the screen panel; and a pair of inserts each embedded within the elongate element proximate one of the ends thereof that is attached to the associated connector bar;

wherein the screen panel is independently removable from the screen panel support while the elongate element and the beater remain attached to the screen panel support.

13. A method of constructing a screening system comprising the steps of:

mating connectors to spaced and parallel girders of the screening system;

releasably coupling each of opposing ends of an elongate element to one of the connectors on the girders thereby spanning the space between the girders with the elongate element and positioning a beater connected to the elongate element between the connectors;

inserting an element into each end of the elongate element to thereby decrease the likelihood of failure of the elongate element during operation of the screening system; and inserting a screen panel between the connectors mated to the spaced and parallel girders so that the beater is juxtaposed to a bottom surface of the screen panel and adapted to repeatedly engage the screen panel during operation of the screening system.

14. The method of claim 13 wherein the releasably coupling and inserting the screen panel steps are performed in the recited order.

15. The method of claim 13 further comprising:

removing the screen panel from between the connectors without removing the elongate element from the connectors.

16. The method of claim 13 further comprising:

replacing the elongate element and the beater without replacing the screen panel from the screening system.

17. The method of claim 13 further comprising:

integrally molding the elongate element and the beater together.

18. The method of claim 17 further comprising:

embedding the insert element in each end of the elongate element to thereby decrease the likelihood of failure of the elongate element during operation of the screening system.

* * * * *